US006223894B1

(12) United States Patent
Lemaire

(10) Patent No.: US 6,223,894 B1
(45) Date of Patent: May 1, 2001

(54) PACKAGE FOR PACKAGING A FOOD PRODUCT

(75) Inventor: Sylvie Lemaire, Otterburn Park (CA)

(73) Assignee: Fempro Inc., Drummondville (CA)

( * ) Notice: Subject to any disclaimer, the term of this patent is extended or adjusted under 35 U.S.C. 154(b) by 0 days.

(21) Appl. No.: 09/426,295

(22) Filed: Oct. 25, 1999

(51) Int. Cl.[7] ..... B65D 81/26
(52) U.S. Cl. ..... 206/204; 426/129
(58) Field of Search ..... 206/204, 213.1, 206/583; 426/106, 124, 129

(56) References Cited

U.S. PATENT DOCUMENTS

| | | | | |
|---|---|---|---|---|
| 3,026,209 | | 3/1962 | Niblack et al. | 99/174 |
| 3,209,978 | | 10/1965 | Dupuis | 229/14 |
| 3,264,120 | | 8/1966 | Westcott | 99/174 |
| 3,575,287 | | 4/1971 | Graveley | 206/45.33 |
| 3,932,575 | | 1/1976 | Andersson | 264/154 |
| 4,319,679 | * | 3/1982 | Gustafsson | 206/204 |
| 4,382,507 | | 5/1983 | Miller | 206/204 |
| 4,576,278 | | 3/1986 | Laiewski et al. | 206/204 |
| 4,840,271 | * | 6/1989 | Garwood | 206/213.1 |
| 4,860,887 | | 8/1989 | Fosse | 206/204 |
| 4,861,632 | | 8/1989 | Caggiano | 428/35.2 |
| 4,903,827 | * | 2/1990 | Phelps et al. | 206/204 |
| 5,431,970 | | 7/1995 | Broun et al. | 428/36.5 |
| 5,514,392 | * | 5/1996 | Garwood | 426/106 |
| 5,552,169 | | 9/1996 | Kannankeril et al. | 426/107 |
| 5,629,060 | * | 5/1997 | Garwood | 426/129 |
| 5,916,613 | * | 6/1999 | Stockley, III | 426/124 |

* cited by examiner

*Primary Examiner*—David T. Fidei
(74) *Attorney, Agent, or Firm*—Darby & Darby

(57) ABSTRACT

Package for packing a food product which likely exudes liquids, which comprises a tray and an upper sheet made of a stretchable liquid impermeable material. The upper sheet which is secured all around to the rim of the tray has a central portion devised to receive thereon the food product and a perforated intermediate portion whereby the intermediate portion is inclined when a food product is laid down on the central portion. The package further comprises a liquid absorbent mat disposed under the upper sheet to absorb any liquids exuding from the food product and passing through the perforated intermediate portion.

12 Claims, 4 Drawing Sheets

PACKAGE FOR PACKAGING A FOOD PRODUCT

FIELD OF THE INVENTION

The present invention relates to the field of package used for packaging food products that tend to exude juice. More specifically, the present invention concerns an improved package that prevents the juices exuding from a food product from going back to the food product vicinity.

BACKGROUND OF THE INVENTION

It has been found desirable for retail stores to display food items in individually wrapped packages. Such individual packages generally comprise a tray with an absorbent pad in the bottom of the tray to absorb any juices or liquids exuding from the food product. An outer plastic wrapping is usually used to cover the food product and tray to complete the package. There have been various attempts to control these liquids in order to extend the shelf-life of such food products. Various packages are known in the art. For example U.S. Pat. No. 4,382,507 discloses an absorbent pad disposed in a food package for absorbing juices or other exuding liquids. The absorbent pad disclosed therein comprises a mat of liquid absorbent material, an upper liquid impermeable plastic sheet overlying the absorbent mat, and a perforated lower plastic sheet underlying the absorbent mat. The upper and lower plastic sheets extend beyond the absorbent mat and are sealed together to enclose the absorbent mat therebetween. When a food product is positioned upon the upper sheet of the absorbent pad, any exuded liquids will flow around the pad and enter the pad by capillary action through the perforations in the lower sheet. The absorbent pad herein described retards reverse migration of exuded liquid to some extent, but still subject to reverse migration when pressure is applied to the pad.

While the inventions known in the art have resulted to the advancement within the present field, an important problem in this area continues to persist. This problem arises from the fact that the package known in the prior art fail to efficaciously absorb and retain exuded liquid from the packaged product. Therefore, these exuded liquids tend to accumulate in the receptacle and to go back to the food product or its vicinity. As a consequence, this provides an environment supportive of the growth and proliferation of microorganisms, thereby minimizing the appearance and shelf-life of the food product.

SUMMARY OF THE INVENTION

It is therefore an object of the present invention to provide a package for a food product that will overcome this drawback. In accordance with the present invention, that object is achieved with a package for packing a food product which likely exudes liquids, the package comprises a tray with a bottom wall and a raised rim. The package further comprises an upper sheet made of a stretchable liquid impermeable material. This upper sheet has a non-perforated central portion devised to receive thereon the food product, a periphery and a perforated intermediate portion defined between the non-perforated central portion and the periphery. The periphery is secured all around to the rim of the tray whereby the intermediate portion is inclined when a food product is laid down on the central portion. A liquid absorbent mat is disposed under the upper sheet to absorb any liquids exuding from the food product and passing through the perforated intermediate portion.

According to a preferred embodiment, the periphery of the upper sheet is secured to a top edge of the rim, and the absorbent mat is securely pressed against the non-perforated central portion of the upper sheet.

As can be appreciated, a package according to the present invention which is characterized by the fact that the upper perforated sheet is secured all around to the raised rim of the tray and thus forms an inclined surface as the food product is laid thereon, prevents the exuded juices that already crossed the upper sheet from going back to the food product vicinity.

BRIEF DESCRIPTION OF THE DRAWINGS

The present invention and its advantages will be more easily understood after reading the following non-restrictive description of a preferred embodiment thereof, made with reference to the following drawings wherein.

DESCRIPTION OF A PREFERRED EMBODIMENT

Figure 1:
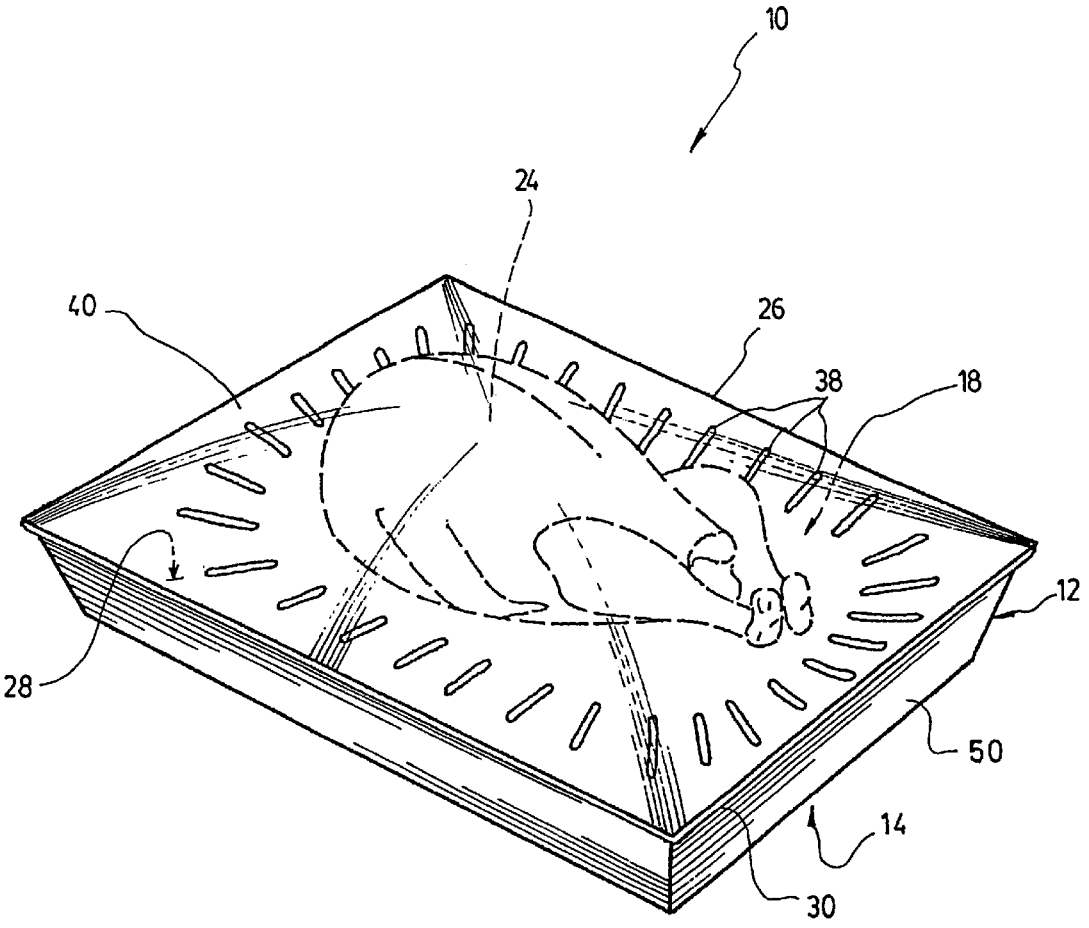
FIG. 1 is a perspective view of a food package according to a preferred embodiment of the present invention, and enclosing a food product.
Figure 2:
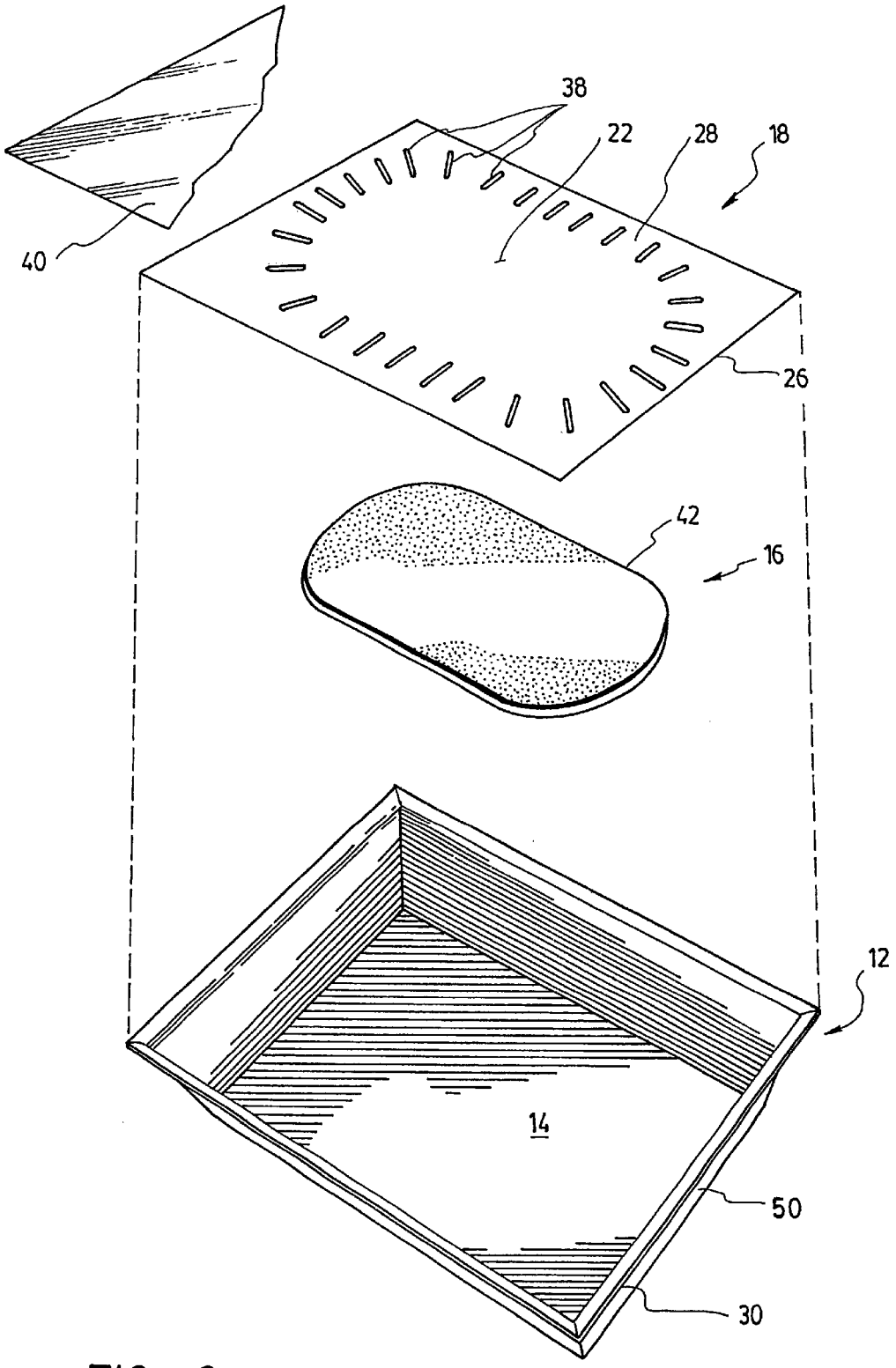
FIG. 2 is an exploded perspective view of the food package shown in FIG. 1.

With reference to FIGS. 1 to 3*b*, an improved package (10) for packaging food products (24) according to the present invention comprises a tray (12) with a bottom wall (14) and a raised rim (50). The tray (12) is preferably made of a relatively rigid material, such as polystyrene material. It will be understood that although it is a tray (12) made of this particular type of material, the present invention contemplates employing trays of other materials commonly used in this field.

The package (10) also comprises a liquid absorbent mat (16) and an upper sheet (18). The upper sheet (18) is made of a stretchable liquid impermeable plastic material such as polyester, polyethylene, polypropylene, or the like. The upper sheet (18) has its periphery (26) secured all around to the top edge (30) of the raised rim (50). It also has a non-perforated central portion (22) devised to receive thereon the food product (24), and a perforated intermediate portion (28) defined between the non-perforated central portion (22) and the periphery (26). Thus, as can be appreciated, the intermediate portion (28) becomes inclined when a food product (24) is laid down on the non-perforated central portion (22). Consequently, as the juices that passed through the apertures of the intermediate portion (28) are absorbed by the absorbent mat (16), the excess unabsorbed juices trapped beneath the upper sheet (18) will be prevented from going back on the upper sheet (18).

The periphery (26) of the upper sheet (18) is preferably chemically or thermally secured to the rim (50). Any methods already known in the prior art may be used. These may include the use of glue or any other chemicals. As an alternative, the periphery (26) may be heat sealed to the rim (50).

The liquid absorbent mat (16) is preferably made of a cellulose fiber material, rayon fiber or cotton fiber, or other absorbent materials, which are known in the art. The absorbent mat (16) is disposed under the non-perforated central portion (22) of the upper sheet (18) so as to absorb any liquids exuding from the food product (24) and passing through the perforated intermediate portion (28).

Figure 3A:
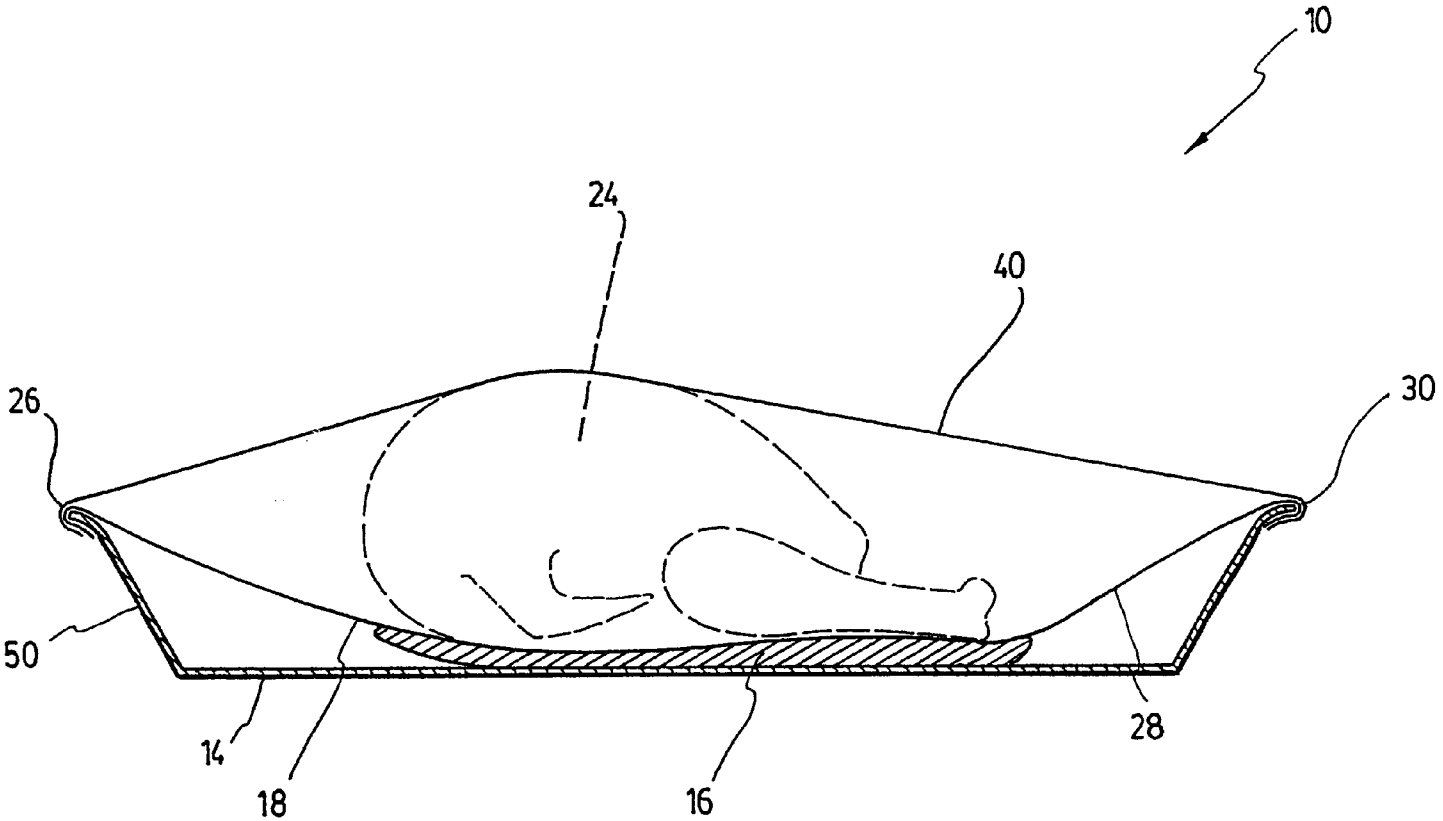
FIG. 3*a* is a cross-sectional side view of the food package shown in FIG. 1, wherein a liquid absorbent mat is bonded to an upper sheet of the package.
Figure 3B:
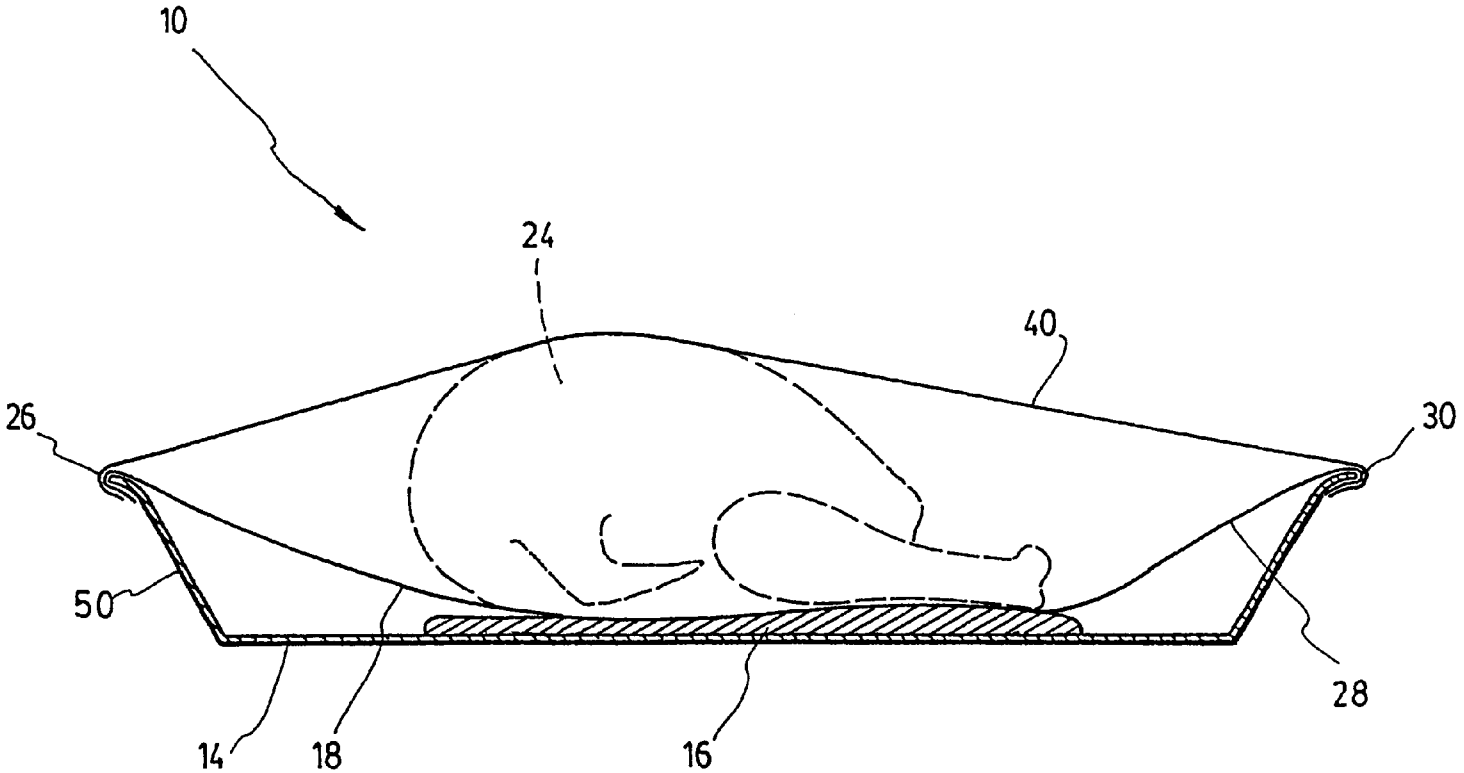
FIG. 3*b* is a cross-sectional side view of the food package shown in FIG. 1, wherein the liquid absorbent mat is simply disposed under the upper sheet.

The absorbent mat (16) may be simply laid on the bottom wall (14) of the tray (12), as in FIG. 3*b*, or it may be thermally, chemically or latex bonded to the non-perforated central portion (22) of the upper sheet (18) as shown in FIG. 3*a*. The apertures (38) in the upper sheet (18) may be disposed in a single row as illustrated or in more that one row.

It has to be understood that in another embodiment of the present invention, the absorbent mat (16) may be sandwiched between the upper sheet (18) and a lower sheet. This lower sheet may be made of stretchable and permeable materials for facilitating, by capillary action, the circulation of the liquid towards the absorbent mat (16). The lower sheet may extend beyond the periphery (42) of the absorbent mat (16) and may have a peripheral portion secured to the upper sheet (18), so as to enclose the liquid absorbent mat (16), between the non-perforated central portion (22) of the upper sheet (18) and a central portion of the lower sheet.

The absorbent mat (16) may advantageously include at least one additive selected from the group consisting of retention agent (such as polyacrylate polymers, starch modified polymers or any type of natural source of gelifying polymers), odour control agent (such as molecular sieves) and bacteria control agent (such as triclosan based compounds).

The package (10) further comprises an overwrap (40), preferably of flexible film material, to cover a food product (24) laid on the tray (12).

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

What is claimed is:

1. A package for packing a food product which likely exudes liquids, the package comprising:

a tray with a bottom wall and a raised rim;

an upper sheet made of a stretchable liquid impermeable material, said upper sheet having a non-perforated central portion devised to receive thereon the food product, a periphery and a perforated intermediate portion between the non-perforated central portion and the periphery, the periphery being secured all around to the rim of the tray whereby the intermediate portion is inclined when a food product is laid down on the non-perforated central portion; and a liquid absorbent mat disposed under the upper sheet to absorb any liquids exuding from the food product and passing through the perforated intermediate portion.

2. A package as claimed in claim 1, wherein the periphery of the upper sheet is secured to a top edge of the rim.

3. A package as claimed in claim 2, wherein the periphery of the upper sheet is chemically or thermally secured to the rim.

4. A package as claimed in claim 1, wherein the absorbent mat is bonded to the non-perforated central portion of the upper sheet.

5. A package as claimed in claim 1, wherein the apertures in the upper sheet are disposed in at least one row.

6. A package as claimed in claim 5, wherein the upper sheet is made of plastic.

7. A package as claimed in claim 6, wherein the absorbent mat is made of a material selected from the group consisting of cellulose fiber, rayon fiber and cotton fiber.

8. A package as claimed in claim 7, wherein the absorbent mat includes at least one additive selected from the group consisting of retention agent, odour control agent and bacteria control agent.

9. A package as claimed in claim 8, further comprising an overwrap of flexible film material to cover a food product laid on the tray.

10. A package for packing a food product which likely exudes liquids, the package comprising:

a tray with a bottom wall and a raised rim;

an upper sheet made of a stretchable liquid impermeable material, said upper sheet having a non-perforated central portion devised to receive thereon the food product, a periphery and a perforated intermediate portion defined between the non-perforated central portion and the periphery, the periphery being chemically or thermally secured all around to a top edge of the rim of the tray whereby the intermediate portion is inclined when a food product is laid down on the non-perforated central portion; and a liquid absorbent mat made of a material selected from the group consisting of cellulose fiber, rayon fiber and cotton fiber, disposed under the non-perforated central portion of the upper sheet to absorb any liquids exuding from the food product and passing through the perforated intermediate portion.

11. A package as claimed in claim 10, wherein the absorbent mat includes at least one additive selected from the group consisting of retention agent, odour control agent and bacteria control agent.

12. A package as claimed in claim 11, further comprising an overwrap of flexible film material to cover a food product laid on the tray.

* * * * *